US005829180A

United States Patent [19]

Leiter

[11] Patent Number: 5,829,180

[45] Date of Patent: Nov. 3, 1998

[54] BLANK-FIRING SEMIAUTOMATIC PISTOLS

[76] Inventor: Edward J. Leiter, Satis House, Tower Hill Rd., Tuxedo Park, N.Y. 10987

[21] Appl. No.: 533,588

[22] Filed: Sep. 25, 1995

[51] Int. Cl.[6] ..... F41A 21/00

[52] U.S. Cl. ..... 42/77; 42/1.07; 89/29; 89/14.5

[58] Field of Search ..... 42/77, 1.07; 89/29, 89/14.5

[56] References Cited

U.S. PATENT DOCUMENTS

| | | | |
|---|---|---|---|
| H926 | 6/1991 | Mahtook | 89/128 |
| 808,003 | 12/1905 | Browning | 42/16 |
| 863,770 | 8/1907 | Whiting | 42/16 |
| 936,967 | 10/1909 | Whiting | 42/16 |
| 1,168,985 | 1/1916 | Whiting | 42/2 |
| 1,377,629 | 5/1921 | Rosebush | 42/16 |
| 1,563,675 | 12/1925 | Tansley | 42/16 |
| 1,618,310 | 2/1927 | Sequin | 73/506 |
| 1,618,510 | 2/1927 | Browning | 89/163 |
| 2,356,538 | 8/1944 | Schmeisser | 42/1.07 |
| 2,664,786 | 1/1954 | Guisasola | 89/163 |
| 2,872,850 | 2/1959 | Davenport | 42/77 |
| 2,898,693 | 8/1959 | Ruger | 89/29 |
| 3,207,037 | 9/1965 | Pachmayr et al. | 89/196 |
| 3,504,594 | 4/1970 | Greeley | 89/196 |
| 3,724,326 | 4/1973 | Day | 89/196 |
| 3,731,590 | 5/1973 | Zimmerman, Jr. | 89/163 |
| 3,756,120 | 9/1973 | Roy | 89/163 |
| 3,901,125 | 8/1975 | Raville | 89/163 |
| 4,128,040 | 12/1978 | Schuetz | 89/14.5 |
| 4,222,308 | 9/1980 | Arnett | 89/163 |
| 4,253,377 | 3/1981 | Arnett | 89/163 |
| 4,494,332 | 1/1985 | Matievich | 42/77 |
| 4,580,484 | 4/1986 | Moore | 89/138 |
| 4,633,755 | 1/1987 | Bertiller et al. | 89/29 |
| 4,854,217 | 8/1989 | Ransom | 89/163 |
| 4,887,510 | 12/1989 | Wynn | 89/163 |
| 4,907,489 | 3/1990 | Teague | 89/14.5 |
| 4,920,676 | 5/1990 | Peters | 42/25 |
| 5,415,075 | 5/1995 | Moon | 89/163 |
| 5,433,134 | 7/1995 | Leiter | 89/14.5 |
| 5,585,589 | 12/1996 | Leiter | 89/128 |

FOREIGN PATENT DOCUMENTS

| | | |
|---|---|---|
| 412523 | 7/1910 | France . |
| 477693 | 11/1915 | France . |
| 319648 | 4/1920 | Germany . |
| 20367 | 9/1910 | United Kingdom . |
| 2163840 | 3/1986 | United Kingdom . |

*Primary Examiner*—J. Woodrow Eldred
*Attorney, Agent, or Firm*—Dilworth & Barrese

[57] ABSTRACT

A semiautomatic pistol adapted to repetitively fire blank ammunition includes a frame, a barrel slidably mounted to the frame, a slide slidably mounted to the frame and adapted for reciprocal longitudinal movement relative to the frame between a forward battery position and a rearward position and an occlusion member at least partially positioned within a longitudinal bore defined in the barrel for generating sufficient back pressure in the barrel to move the slide rearwardly to the rearward position thereof. The occlusion member defines a length ranging from about 15% to about 60% the length of the barrel.

26 Claims, 4 Drawing Sheets

BLANK-FIRING SEMIAUTOMATIC PISTOLS

BACKGROUND OF THE INVENTION

1. Technical Field

The present invention relates to recoil-operated, breech-locked semiautomatic pistols and, more particularly, to a semiautomatic pistol having a drop-in, self contained barrel unit which permits repetitive blank-fire operation. Moreover, the present invention is directed to a semi-automatic pistol capable of repetitive discharge of blank training ammunition in a manner that produces no forward discharge from the muzzle of the firearm, while both generating diminutive sound levels and precluding the possibility of chambering a live cartridge of the same caliber into the blank-fire barrel.

2. Background of Related Art

Conventional semi-automatic weapons of the breech-locked, recoil-operated tilting-barrel design, such as those based upon principles common to the Browning and Colt/Browning family, may be adapted for repetitive blank-fired operation by implementation of the modified breech lock mechanism disclosed in U.S. Pat. No. 5,433,134 to Leiter. In accordance with the Leiter '134 patent, a reciprocating slide element of the pistol contacts either an obliquely angled incline on the barrel outer chamber area or a rearwardly displaced vertical abutment shelf on the barrel outer chamber area to effect rearward barrel motion, downward tilt to allow expended case ejection, and retention of the barrel in the proper orientation to accept a fresh cartridge into the firing chamber of the weapon. This format permits repetitive cycling of the mechanism when used in conjunction with a bore-restricting element of appropriate geometries for the purposes of generating sufficient back pressure in the absence of a live cartridge, and will accomplish successful operation in linked or linkless tilting barrel configurations where the primary locking provision is created by interaction of a locking surface or rib contained within the upper inner surface of the slide, or formed by the ejection port area of the slide, and a corresponding locking surface or rib formed by the outer surface of the barrel chamber element.

However, a variant class of breech-locked firearms, such as the Beretta M1951/M92 class and, priorly, the Walther P38-type, utilizes no tilting barrel motion for normal operation, and further contains no such upper-slide or ejection port/barrel interconnecting locking surface. Operation of this class of firearms depends upon a rearwardly moving barrel which traverses a longitudinal plane of retaining rails within the frame. These retaining rails are parallel to a corresponding set of rails which interconnect the slide and frame of the weapon. Breech locking of the barrel and slide occurs by the action of a wedged or dropping locking block movably affixed to the underside of the barrel, and movably engaging recesses cut into the slide which receive the engagement portion of this locking block. Disengagement of the locking element from the slide and consequent opening of the breech and chamber of the barrel is accomplished by the interaction of a plunger movably attached to the barrel. This plunger is driven forward by contact with the frame as the locked barrel/slide assembly travels rearwardly under recoiling forces of a discharging cartridge. The interaction of the plunger subsequently urges the locking block downward and out of contact with the slide by a camming effect, thereby permitting the slide to travel rearward longitudinally and independently of the barrel unit, which is arrested in its further rearward motion by abutment with a portion of the frame. As the slide continues its recoiling motion, the actions of cartridge case ejection, recocking of the firing mechanism, subsequent introduction of a fresh cartridge into the chamber, and all of other operations associated with normal operation of this class of firearms occur.

As pertains to blank-fire operation, even with the introduction of a bore-restricting element common to the art, unlocking the breech will not occur in the absence of projectile-motivated forces as disclosed in the Leiter '134 patent described above. Provision must, therefore, be made to overcome the mechanical impediments posed by this particular type of locking feature. Furthermore, the ability of the weapon to discharge conventional blank ammunition, and particularly in the case of weapons lacking a delayed breech-opening provision, entails four distinct consequences which limit the usefulness of a firearm so adapted to employment in close quarters training applications.

First, a substantial gaseous and particulate discharge emanates from the muzzle of the firearm under high pressure, which is augmented by the venturi effect of the bore-occluding element necessary for generating thresholds of back pressure to cycle the mechanism. Even with the implementation of gas diffusing vents to direct the ejecta radially or at angles offset from the line of the bore, substantial pressure prevails and, consequently, considerable distances must be maintained between the muzzle of the weapon and the person or object fired upon. This compromises the utility of a firearm so disposed in situations of close quarters training.

Secondly, the noise level generated by this discharge dictates the use of hearing protection consequent to conventional blank-fire application. The velocity of gases generated in blank fire is substantially increased by compression through the bore-occluding passageway normally employed and associated with the creating of back pressure in such adaptions to effect operation of the firearm mechanism. Consequently, the supersonic velocities achieved by these forwardly or radially discharging gases as they exit the venturi or gas dispersing orifice produce a sonic boom effect of substantial decibel level, thereby necessitating the use of hearing protection during operation.

Thirdly, failing some means to provide for substantial consumption of propellant powders within the barrel bore before opening of the breech occurs, significant residual discharge in the form of particulate matter will accompany opening of the breech and ejection of the expended cartridge case.

Fourthly, substantial hazard attends the adaption of a firearm to chamber a blank cartridge of conventional caliber and headspacing characteristics, where such a blank-modified weapon can readily accept a live cartridge of like caliber and geometries, thus introducing a further detriment to the use of such a firearm in training applications.

SUMMARY

The present invention addresses these issues to produce a barrel element permitting repetitive blank-fire in under-barrel dropping-block, locked-breech firearms while effecting no cosmetic or dimensional alterations to the weapon. Furthermore, and as pertains equally to tilting barrel, recoil operated, locked-breech firearms, it creates no muzzle discharge, generates highly diminished report, substantially eliminates residual particulate discharge from the chamber of the weapon, and precludes the chambering of conventionally dimensioned live ammunition of the same caliber.

Generally stated, the present invention is directed to a semi-automatic pistol adapted to repetitively fire blank ammunition. The pistol includes a frame, a barrel slidably mounted to the frame and having a barrel chamber portion and a barrel element, a slide slidably mounted to the frame and adapted for reciprocal longitudinal movement relative to the frame between a forward battery position and a rearward position and an occlusion member at least partially positioned within a longitudinal bore defined in the barrel for generating sufficient back pressure in the barrel to move the slide rearwardly to the rearward position thereof. The occlusion member defines a length ranging from about 15% to about 60% the length of the barrel.

The barrel chamber portion may have a rearwardly displace headspace surface thereby defining a reduced cartridge headspace of the pistol. Similarly, the blank cartridges for use with the pistol have a correspondingly reduced headspace measurement. By these modifications, only the blank cartridge having specific dimensional characteristics may be loaded within the altered chamber thereby precluding the possibility of live ammunition being loaded within the modified pistol arrangement.

BRIEF DESCRIPTION OF THE DRAWINGS

Various embodiment(s) of the present disclosure are described hereinbelow with reference to the drawings wherein.

DETAILED DESCRIPTION OF PREFERRED EMBODIMENTS

Figure 1:
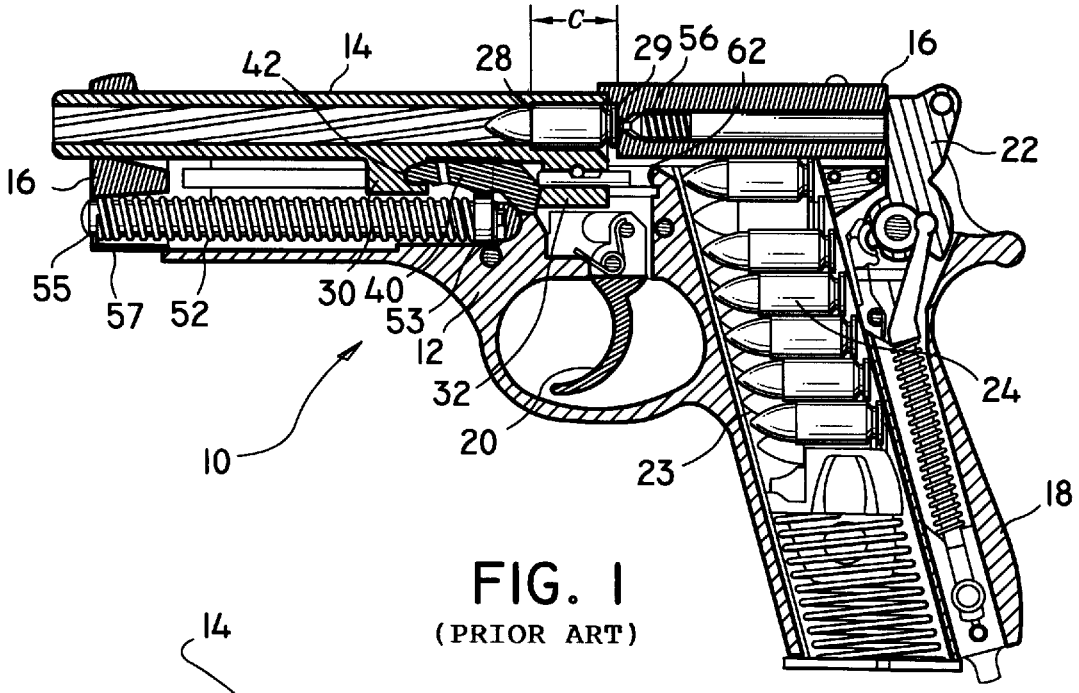
FIG. 1 (PRIOR ART)
FIG. 1 is a side elevational view in cross-section of a conventional Beretta M1951/M92 model pistol which can be adapted in accordance with the principles of the present invention to fire blank ammunition, repetitively, and depicts the frame, barrel, slide and locking block.
Figure 2:
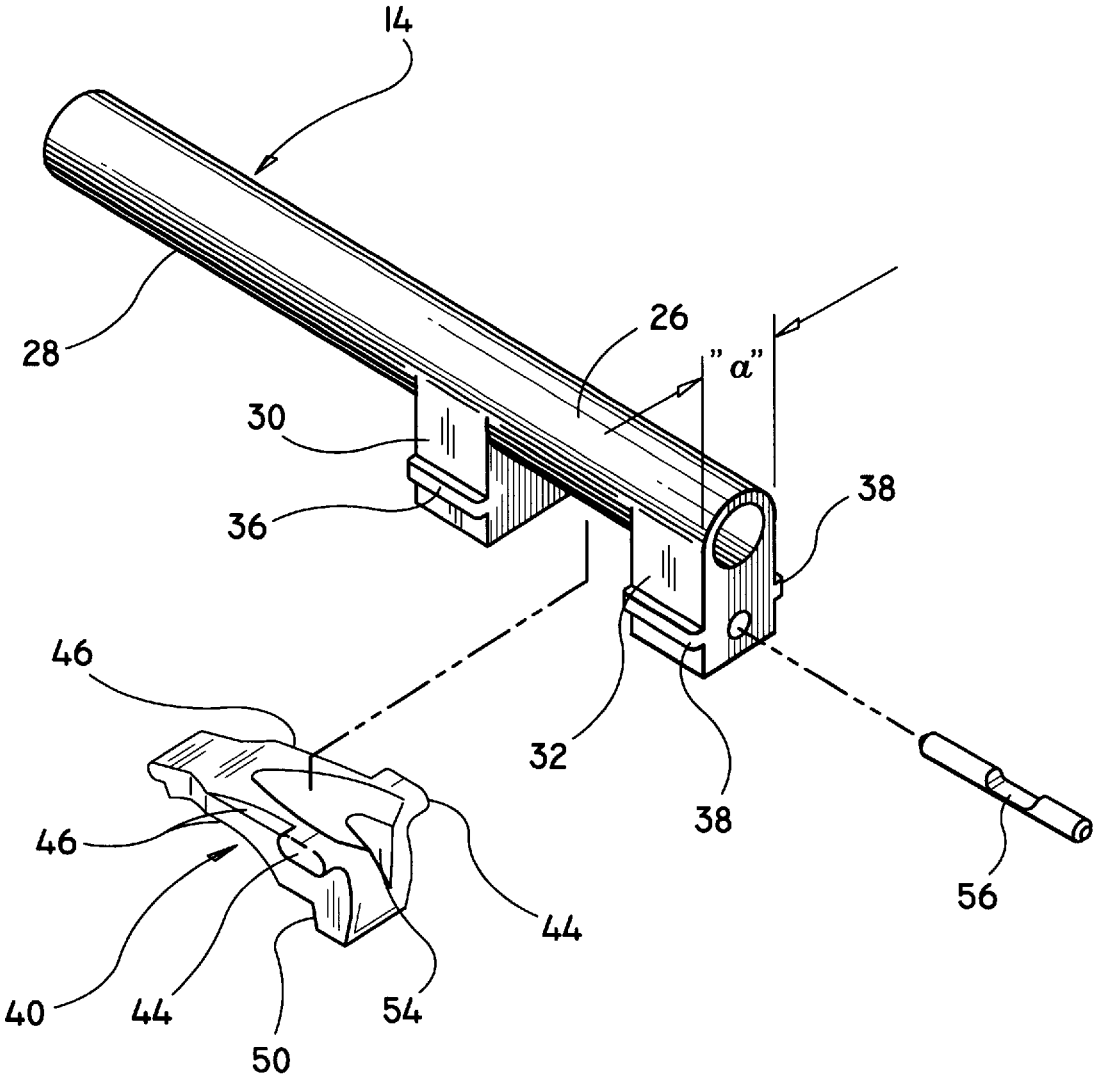
FIG. 2 (PRIOR ART)
FIG. 2 is a perspective view of the barrel unit of the pistol of FIG. 1 illustrating the barrel and associated locking block.

Referring initially to FIGS. 1–2, there is illustrated a standard Beretta M1951/M92 class firearm capable of being adapted to fire blank ammunition repetitively in accordance with the principles of the present disclosure. Pistol 10 generally includes three principal components, namely, frame 12, barrel 14 and slide 16. Frame 12 includes grip portion 18 and a trigger mechanism having trigger 20 and hammer 22. A magazine 24 for storing a plurality of cartridges is supported by the frame.

Figure 3:
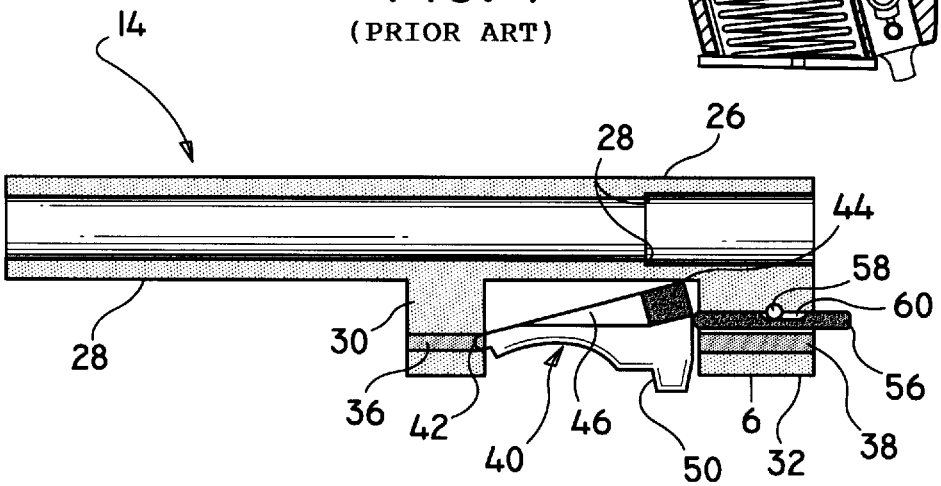
FIG. 3 (PRIOR ART)
FIG. 3 is a schematic view of the barrel of FIG. 2 illustrating the locking block in an upper, locked position.

Referring now to FIGS. 2–3, in conjunction with FIG. 1, barrel 14 includes barrel chamber 26 and barrel element 28 extending longitudinally from the chamber 26. Barrel chamber 26 defines an inner chamber having an inner cartridge arresting shelf, or headspacing surface 28 (FIGS. 1 and 3), which maintains a cartridge in a fixed firing position relative to the breech face 29 of slide 16. Projecting from the lower surface of, and integral to, barrel 14 are two pillars 30, 32 which depend vertically from the point of greatest barrel diameter represented by "a" in FIG. 2. Pillars 30, 32 incorporate machined raised rails 36, 38, respectively, on each side of the pillars 30, 32, which extend parallel to each other and within the same plane. Rails 36, 38 are received within corresponding grooves defined within frame 12 to slidably mount barrel 14 to the frame 12. Other means for slidably mounting barrel 14 to frame 12 are envisioned by one skilled in the art as well.

Figure 4:
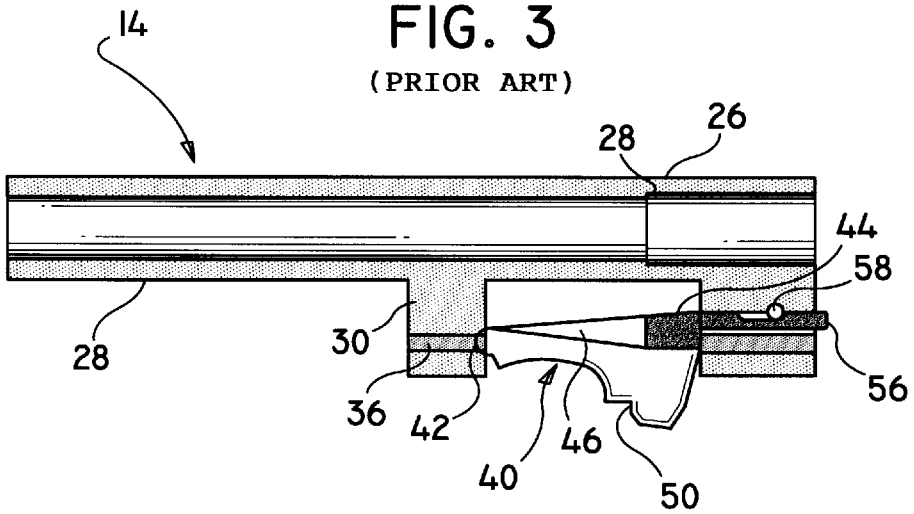
FIG. 4 (PRIOR ART)
FIG. 4 is a view similar to the view of FIG. 3 illustrating the locking block in a lower, unlocked position.

Referring still to FIGS. 1–3, a wedge-shaped locking block 40 is affixed to forward pillar 30 at pivot point 42. Locking block 40 is movable about pivot point 42 between an upper position depicted in FIG. 3 and a lower position depicted in FIG. 4. Rearwardly, disposed at each side of locking block 40 are locking wings 44 which extend outwardly from accompanying shelf areas 46. The width between shelf area 46 is less than or equal to the diameter of barrel 14. Locking wings 44 protrude beyond the diameter of barrel 14 and are received within correspondingly dimensioned locking recesses defined in the upper surface of slide 16 to lock the slide 16 to barrel 14 in the forward battery position of the pistol 10. Locking block 40 incorporates a generally vertical face 50 which supports and retains the rearmost end of recoil spring guide 53 of the recoil spring mechanism 52 (FIG. 1) and also possesses an obliquely oriented interior camming surface 54 (FIG. 2). A cam pin 56 is reciprocally mounted within a longitudinal bore defined through the center of pillar 32. Cam pin or plunger 56 is retained within the pillar 32 by a transverse cross pin 58 (FIG. 3) which is received within longitudinal recess or groove 60 defined in the pin 56. Transverse cross pin 58 is fixedly mounted to pillar 32. Plunger 56 is reciprocally longitudinally movable relative to pillar 32 between forward and rear positions. As noted in further detail hereinbelow, depression of plunger 56 from the rear (as shown in FIG. 4), will force locking block 40 downwardly as effectuated by the camming action of the plunger against camming incline 54 (FIG. 2) defined within locking block 40.

The operation of the pistol 10 of FIGS. 1–4 will now be discussed. In the forward battery position of the pistol 10, barrel 14 and slide 16 are in their forwardmost position. Locking block 40 is in its upward position of FIG. 3 whereby locking wings 44 are received within the correspondingly dimensioned locking recesses of the slide 16 to effectuate the breech locking of the barrel 14 and the slide 16 in a known manner. Upon firing of pistol 10, barrel 14 and slide 16 move in concert rearwardly. As barrel 14 moves rearwardly, plunger 54 is driven forwardly relative to barrel 14 through its rearward engagement with an inner bearing surface area 62 (FIG. 1) of the frame 12. This relative forward movement through pillar 32 causes the locking block 40 to assume its downward position through the interaction of plunger 56 with cam surface 54 of the locking block 40. As a result of this action, locking wings 44 are displaced from their position within the locking recesses of slide 16 thereby releasing slide 16 to permit the slide to continue its rearward recoiling motion independently of barrel 14. As slide continues its recoiling motion, the actions of the firing lock mechanism, subsequent introduction of a fresh cartridge into chamber portion 26 and all other operations associated with normal operation of this class of firearms occurs. Slide 16 is arrested in its rearwardmost position by abutment with an abutment surface of frame 12. Thereafter, slide 16 is returned to battery under the influence of the recoil spring mechanism 52. During such movement of slide 16 to its forward battery position, barrel 14 is driven forward whereupon by operation of an incline surface of frame 12 and under assisting influence of the pressure of recoil spring 55 upon recoil spring guide 53 in its contact with surface 50, locking wings 44 are caused to pivot upwardly to the position depicted in FIG. 3 to be lockingly received within the locking recesses of slide 16 to urge barrel 14 to its forward battery position as well.

Figure 5:
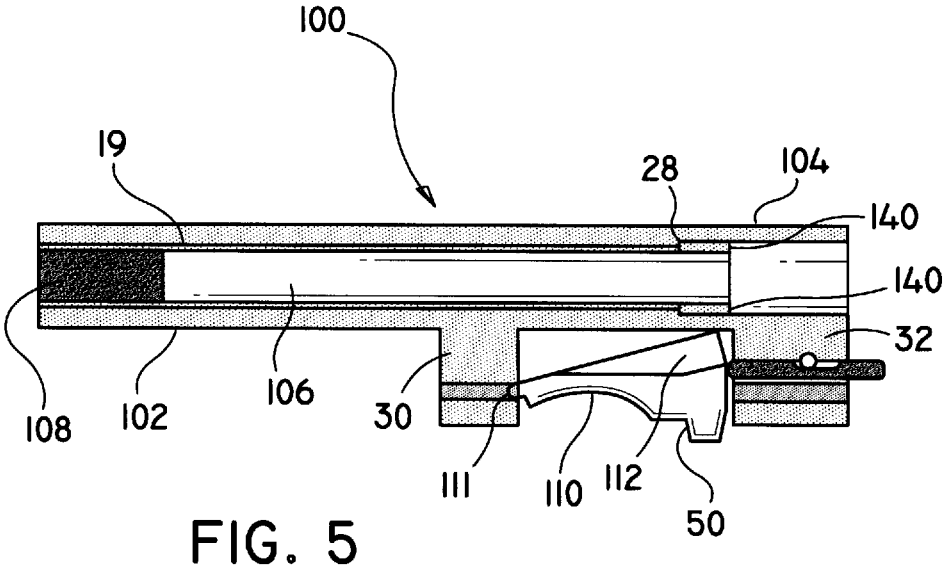
FIG. 5 is a schematic view of a barrel modified in accordance with the principles of the present invention to be incorporated in the pistol of FIG. 1 to fire blank cartridges repetitively.
Figure 6:
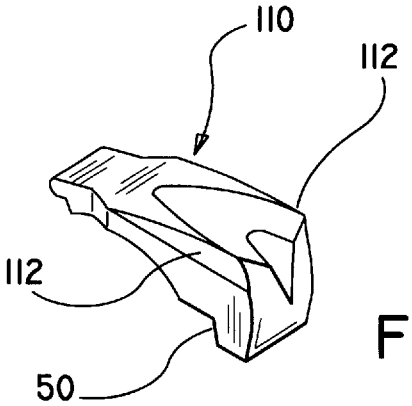
FIG. 6 is a perspective view of the locking block component utilized with the barrel of FIG. 5.

Referring now to FIGS. 5 and 6, a preferred embodiment of a barrel unit as adapted to fire blank ammunition in accordance with the principles of the present invention is illustrated. Barrel 100 is intended to be incorporated in the pistol of FIG. 1 and includes barrel element 102 and chamber portion 104. Barrel element 102 has a bore 106, which is reduced in diameter relative to the bore of the conventional live firing barrel of FIG. 2 as shown. The bore of the live firing barrel of FIG. 1 is represented as numeral 19 in FIG. 5. Bore 106 has a muzzle occlusion 108 disposed at the forward end thereof. Occlusion 108 may be either machined as part of the original modified barrel unit 100, or may be affixed to the barrel 100 by threading, brazing, welding or any similar means common to one knowledgeable in the art. Occlusion 108 completely seals bore 106 and functions in increasing the back pressure of the propellant gases to facilitate firing of blank ammunition. The length of occlusion 108 may range from about 15% to about 60% of the overall length of barrel 100. In a preferred embodiment occlusion 108 extends for about 11/5 or 20% of the length of the barrel.

Referring still to FIGS. 5–6, in accordance with a preferred embodiment, locking block 110 has been modified from the original configuration shown in FIG. 2. In particular, locking block 110 has two opposed planar shelves or surfaces 112 disposed on the sides of the locking block 110, i.e., the original locking wings 48 of block 40 have been eliminated. Shelves 112 are in general parallel relation to each other. The width of locking block 110 between planar shelves 112 is preferably equal to or less than the diameter of barrel 100 at the point of greatest barrel diameter represented by "a" shown in FIG. 2. As shown, locking block 110 retains vertical shelf 50 to support recoil spring guide 53 of the recoil spring mechanism 52 in a similar manner to that described above.

Figure 7:
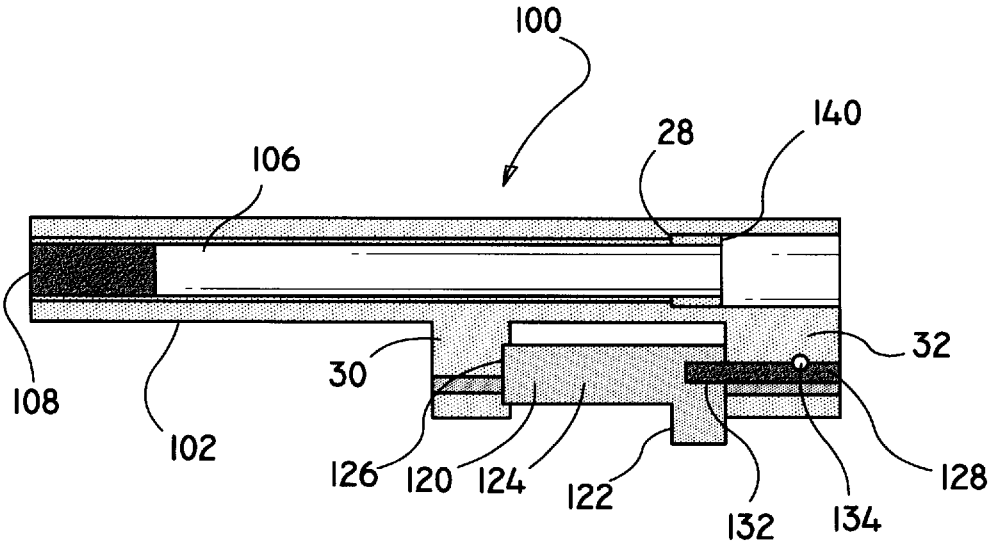
FIG. 7 is a schematic view of an alternative embodiment illustrating a stationary locking block component utilized with the barrel of FIG. 5.

FIG. 7 illustrates an alternative embodiment of the present invention. In accordance with this embodiment, movable locking block 110 is replaced with a stationary component or counterpart 120. Stationary component 120 incorporates a generally vertical area 122 for retaining the rearward portion of the recoil spring guide 53. Stationary component 120 has opposed longitudinally extending planar side walls 124. The "width" or distance between side walls 124 is equal to or less than the outer diameter of the barrel 100 and also equal to or less than the width of pillars 30, 32 at the surface beneath the plane of railings 30, 32. Stationary component 120 is affixed to barrel 100 through a receiving slot 126 defined in forward pillar 30, while being secured by a dead-pin 128 which passes through rear pillar 32 and into a receiving bore or counterpart 132 in the stationary component 120. Alternatively, stationary component 120 may be secured to pillar 30 by pinning. Dead-pin 128 is further secured to pillar 32 by a cross pin 134 driven through the pillar 32. In a further alternative embodiment, stationary component 120 may be machined into or manufactured as an integral element of modified barrel 100.

Referring again to FIGS. 5 and 7, the features of barrel chamber 104 will be discussed. Barrel chamber 104 defines a reduced chamber length as compared to the chamber length of the conventional barrel 16 of FIG. 1 thus reducing the chamber headspace area or headspace measurement of the pistol. With reference to FIG. 1, the headspace measurement is defined as the distance between the forward headspace or cartridge positioning headspace surface 28 of the chamber 26 and the rear supportive surface of the breech face 29 of the slide 16. The purpose of the supporting indices of the headspace is two-fold: (1) to maintain the cartridge in fixed firing position within the chamber 26 where it can receive the proper igniting force of the firing mechanism; and (2) to limit rearward motion of the cartridge case by indexed positioning against the breech face 29 as the projectile moves forward upon ignition, whereby the case maintains full supportive enclosure within the chamber walls, thus preventing case rupture by the expanding propellant gases should the cartridge case be allowed to move rearwardly from the containment walls of the chamber.

In the barrel 100 of FIGS. 5 and 7, the cartridge positioning headspace surface 140 is rearwardly displaced relative to the original headspace surface 28 of the barrel 14 (shown in phantom) of FIG. 1 thereby, as stated above, defining a reduced headspace of the pistol. With the Beretta M1951/M92 class firearm depicted in FIG. 1, in, e.g. "9 mm Luger" caliber, the chamber headspace of the pistol of FIG. 1 is preferably reduced from its original length of 0.744 inches–0.754 inches to a modified chamber headspace ranging from about 0.444 inches to about 0.743 inches, preferably, about 0.59 inches. As will be appreciated, this reduction in chamber headspace in conjunction with corresponding modifications to the blank cartridges precludes the possibility of live ammunition being loaded within barrel 100.

Figure 8:
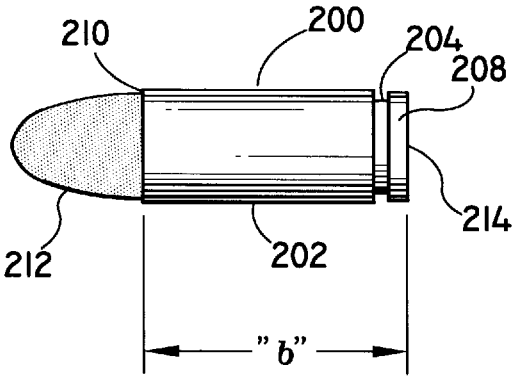
FIG. 8 (PRIOR ART)
FIG. 8 is a side elevational view of a conventional rimless "9 mm Luger" live cartridge to be used with the conventional barrel of FIG. 2.

Referring now to FIG. 8, a typical rimless live "9 mm Luger" cartridge which is to be used in the pistol of FIG. 1 for live firing is illustrated. Cartridge 200 includes a cartridge case 202 having an extraction groove 204 at one end. The extraction groove 204 defines a case head or web 206 on its one side and a rim 208 on its other side. The forward end of the case defines a headspacing surface or case mouth 210. A projectile or head 212 extends from the case mouth 210. Cartridge 200 has a headspace measurement identified as "b" which is the distance between the case mouth 210 and the rear abutment surface 214 adjacent the rim. For all cartridge types including the "9 mm Luger" cartridge, the headspace measurement of the particular cartridge must fall within predetermined ranges in order to operate with the appropriate pistol type, i.e., the headspace measurement of the cartridge must approximate the headspace measurement of the pistol.

Figure 9:
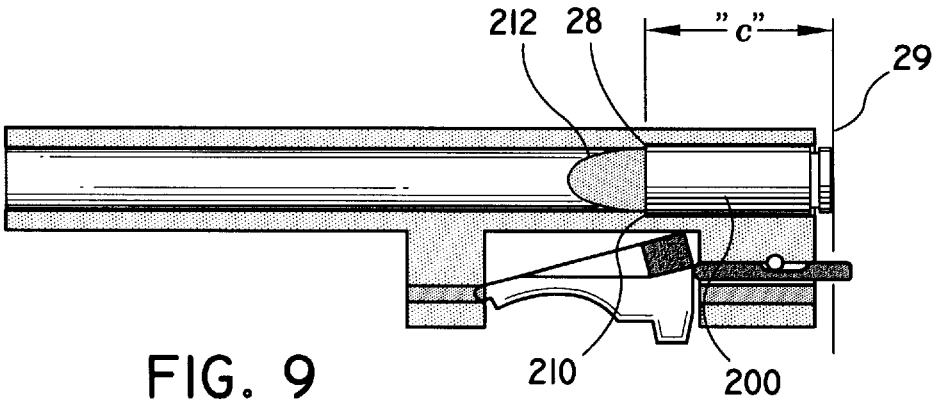
FIG. 9 (PRIOR ART)
FIG. 9 is a side view illustrating the "9 mm Luger" cartridge of FIG. 8 loaded within the barrel chamber of the barrel of FIG. 2.

FIG. 9 depicts the live 9 mm cartridge 200 of FIG. 8 loaded within barrel 14 of the conventional Beretta pistol of FIG. 1. As shown, the case mouth 210 preferably abuts against the original headspace surface 28. The headspace measurement of the pistol is identified as "c" and is the distance between the forward headspace surface 28 and the breech face 29 of the slide as identified schematically in FIG. 9. FIG. 1 also depict the headspace measurement "c" of the pistol 10.

Figure 10:
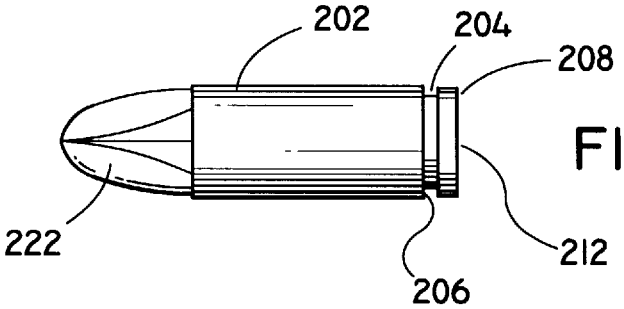
FIG. 10 is a side elevational view of a conventional rimless "9 mm Luger" blank cartridge.

Referring now to FIG. 10, a conventional rimless blank "9 mm Luger" cartridge 220 is illustrated. With conventional blank cartridges, the live projectile or head is typically replaced with a crimped projectile-shape extended brass case identified as reference numeral 222. All of the other dimensional characteristics of the live cartridge are retained. In particular, the original headspacing surface 210 is retained to correspond to the headspace measurement of the "9 mm Luger" pistol, in this example, the Beretta M1951/M92 firearm. In addition, the extended brass case 222 is dimensioned such that the overall length of the blank cartridge is substantially equal to the overall length the live cartridge of that type to accord with the characteristics of the live-fire pistol, frame, slide and barrel assemblies.

Figure 11:
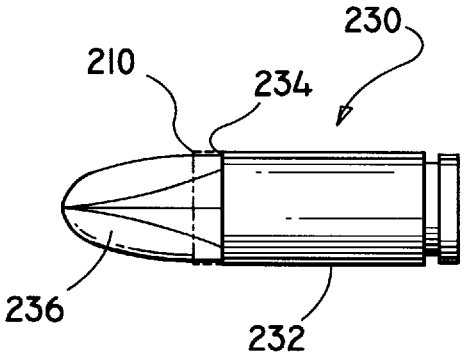
FIG. 11 is a side elevational view of the "9 mm Luger" blank cartridge of FIG. 10 adapted to be used with the barrel of FIG. 5 and FIG. 7 in accordance with the principles of the present invention.

Referring now to FIG. 11, a blank cartridge modified in accordance with the principles of the present invention is illustrated. Blank cartridge 230 is an adaptation of the "9 mm Luger" blank cartridge of FIG. 9. In particular, blank cartridge 230 has been strategically dimensioned and configured to be used with the barrel 100 of FIGS. 5 and 7. More specifically, blank cartridge 230 has a cartridge case 232 which defines a rearwardly displaced headspacing surface or case mouth 234 (relative to cartridge 200), thus, decreasing the overall headspacing measurement of the blank cartridge. The original location of headspacing surface 210 of cartridge 200 is shown in phantom in FIG. 10. It is to be appreciated that headspacing measurement of cartridge 230 preferably approximates the modified headspacing measurement of chamber 104 of barrel 100. In this manner, barrel unit 100 accepts and functions only with the altered blank cartridge 230.

Blank cartridge 230 also incorporates an extended crimped brass projectile 236. Projectile 236 is appropriately dimensioned such that the overall length of the cartridge 230 approximates the overall length of the "9 mm Luger" live cartridge depicted in FIG. 8 to accord with the characteristics of the live-fire pistol, frame, slide and barrel assemblies. By effecting such changes to cartridge 230 and barrel chamber 104, the possibility of loading a live cartridge or a standard full-charge blank cartridge into a barrel altered for operation with a specific light charge blank would be obviated.

It is to be appreciated that the adaptations incorporated in the cartridge of FIG. 10 along with the corresponding modifications to the headspacing area of barrel 100 is not limited to an automatic pistol of the Beretta M1951/92 class firearm. For example, it is contemplated that these principles can be applied to other pistol types and cartridges such as a Glock 17/Sig-Sauer P226 derivative firearm, the Ruger P85/P89/P90, the Smith & Wesson 39/59/5900/6900 series, Browning and Colt/Browning-derivative firearms as well as other recoil-operated breech-locked pistols, and chambered in, but not limited to, caliber 9 mm Parabellum 0.45 ACP, 0.40 S&W, 10 mm, 9 mm Winchester.

The following table illustrates preferred examples of conventional live cartridges and corresponding blank cartridges adapted in accordance with the principles of the present invention. The first column of the table identifies the cartridge type. The second column indicates the required headspacing measurements of the respective live cartridge to be used with a corresponding pistol for live cartridge firing. The third column depicts the length of the cartridge. The fourth column identifies the modified headspacing measurement of the blank cartridge in accordance with the present invention. The fifth column identifies the preferred headspacing dimension of the modified blank cartridge.

| Cart. Size | Original Headspac. | Orig. Length | Modified Headspace | Nominal Headspace |
|---|---|---|---|---|
| 9 mm | .744–.754 | 1.000–1.169 | .444–.743 | .559 |
| 10 mm | .982–.992 | 1.240–1.260 | .330–.981 | .687 |
| 45ACP | .889–.898 | 1.190–1.275 | .500–.887 | .746 |
| 40S + W | .840–.850 | 1.085–1.135 | .365–.839 | .655 |

Thus, a 9 mm cartridge which has a headspacing of 0.744–0.754 for live fire is converted in accordance with the principles of the present invention to have a modified headspace of 0.444–0.743 and, more preferably, 0.559, to be used in a correspondingly modified barrel unit 100. The overall length of the cartridge 230 need not change.

Operation of the barrel 100 of FIGS. 5–7 with the blank cartridges of FIG. 10 will be now be discussed. In operation, modified barrel 100 of FIGS. 5 and 7 receives blank cartridge 230 within cartridge barrel chamber 104. Upon discharge of cartridge 230, the expanding gases generate pressure within the bore 106, which pressure is augmented by the action of the occlusion 108 at the muzzle. Secondarily, the pressure within cartridge case 232 of cartridge 230 expands the case walls and modified, elongated case neck or projectile 236, forming a seal between cartridge headspacing surface or shoulder 234 of the cartridge 230 and headspace surface 140 of the chamber 104. The increased length and surface area of the narrow, extended cartridge neck or projectile 236, necessitated in consequence of the altered chamber configuration, augments the sealing effect of the gases which, in conjunction with the relatively long bore 106 and muzzle occlusion 108, effect highly efficient combustion of the propellant powders. The thrust imparted through cartridge case 230 against the breech face 29 (FIG. 1 or FIG. 9)drives the slide 16 rearward without any interaction or breech lock with barrel 100 due to the configuration of locking block 110 or stationary locking component 120, i.e., without the interaction of locking wings, slide 16 moves freely. As slide 16 moves rearwardly, the expended cartridge case 230 is extracted from chamber and ejected from the weapon, whereupon a new cartridge 232 is introduced into the chamber by the action of the reciprocating slide motion under influence of recoil spring mechanism 52. As slide 16 returns to battery, breech face 29 urges the barrel 100 to its forward battery position as well.

In the embodiment of FIG. 5, barrel 100 essentially "free floats" within frame 12. Rearward movement of slide 16 and corresponding compression of the recoil spring mechanism 52 exerts a force on surface 50 of locking block 110, which causes the locking block to pivot about pivot point 111 without substantial urging of the barrel 100 in a rearward direction. However, chambering of the barrel 100 with the blank cartridge is still achieved. In the embodiment of FIG. 7, rearward movement of slide 16 and consequent compression of the recoil spring mechanism 52 causes the end of recoil spring guide 53 to exert pressure upon surface 122 of stationary component 120, which urges the barrel 100 rearward to a rearward position to accept a fresh round.

It is to be appreciated that by the interaction of the occluded muzzle element 108 and the highly efficient gas seal at the chamber headspacing surface 140 of barrel 100, three phenomena occur beyond the effect of moving the slide component. First, the absence of forward gas release through an aperture maintains a sustained and elevated combustion temperature of the propellant powder within the occluded bore. Consequently, particulate matter in the form of powder granules only partially consumed under normal blank-fire, orifice-present conditions is more efficiently and completely combusted and converted into gaseous form, thus eliminating the incidence of particulate discharge upon breech opening and cartridge extraction.

Second, both the absence of jet-effect and attendant resultant increased velocity of discharging gases created through the action of a restricting orifice at the muzzle, and the newly created opportunity for substantially increased area of gaseous dissipation over a shorter interval of time which is presented by the opening of the breech and attendant extracting of the cartridge case from the chamber results in a lower velocity of gaseous release and, hence, markedly diminished sound levels. As well, the occluded muzzle acts to block sound generation, as well as to create a muffling or silencing effect within the bore, which now becomes an expansion chamber to contain the gaseous effluence and to stabilize the volume of gaseous discharge being produced within a lower velocity range.

Third, as a result of the occluded muzzle and the increased volumetric area within the bore/headspacing surface in which combustion of powders and conversion to gaseous states takes place, particulate emission at the ejection port is minimized.

Further, by the operation of an altered chamber configuration with modified headspacing characteristics, breech closure on live ammunition is obviated. It is to be noted that such chamber alteration may be incorporated into the manufacture of the barrel unit or may be accomplished by introduction of a spacing ring of appropriate dimensions and geometries into the existing chamber. This ring may be affixed by press-fitting, welding, soldering or other means available to one versed in the art.

It is to be noted that, while the above cited embodiments are directed toward the Beretta M1951/M92 class of firearms, they will apply equally to Walther P38 configuration, which operates along similar principles, though disposes the arrangement of locking block and barrel railing provisions in slightly differing configuration. As pertains to the geometries of the Walther barrel and block relationship, the applicable embodiment would specify the distal width of the block component to be equal to or less than the outer diameter of the barrel chamber portion as determined by the outer dimensions of the cylindrical form defined by the chamber diameter.

While the above description contains many specifics, these specifics should not be construed as limitations on the scope of the invention, but merely as an exemplification of a preferred embodiment thereof. Those skilled in the art will envision other possible variations that are within the scope and spirit of the invention as defined by the claims appended hereto.

What is claimed is:

1. A firearm adapted to fire blank ammunition which comprises:

a frame;

a barrel including a barrel chamber and a barrel element extending from said barrel chamber;

a slide mounted with respect to said frame and adapted for reciprocal longitudinal movement relative to said frame between a forward battery position and a rearward position; and an occlusion member at least partially positioned within a longitudinal bore defined in said barrel element, said occlusion member dimensioned to substantially block at least forward discharge of gases to thereby generate sufficient back pressure in said barrel to move said slide rearwardly to said rearward position thereof.

2. The firearm according to claim 1 wherein said occlusion member defines a length ranging from about 15% to about 60% the length of said barrel element.

3. The firearm according to claim 2 wherein said occlusion member defines a length equal to about 20% of the length of said barrel element.

4. The firearm according to claim 1 including a recoil spring mechanism operatively engageable with said slide for urging said slide to said forward battery position.

5. The firearm according to claim 4 wherein said slide defines a breech face, said breech face engaging said barrel upon movement of said slide to said forward battery position to urge said barrel to a forward position thereof.

6. The firearm according to claim 5, further including a support member associated with said barrel and defining a retaining surface in contacting engagement with said recoil spring mechanism, said retaining surface for supporting an end portion of said recoil spring mechanism.

7. The firearm according to claim 6 wherein said support member is securely fixed to said barrel.

8. The firearm according to claim 4 wherein said barrel chamber defines a rearwardly displaced headspacing surface, said headspacing surface and said breech face of said slide defining a headspacing distance when said slide is in said forward battery position.

9. The firearm according to claim 8 including a magazine having at least one blank cartridge to be loaded in said barrel chamber, said one blank cartridge including a cartridge case defining a modified cartridge headspacing distance, said modified cartridge headspacing distance approximating said barrel headspacing distance.

10. The firearm according to claim 9 wherein said one blank cartridge is a 9 millimeter (mm) blank cartridge, said modified cartridge headspacing being less than about 0.744 inches.

11. The firearm according to claim 9 wherein said one blank cartridge is a 10 millimeter (mm) blank cartridge, said modified cartridge headspacing distance being less than about 0.982 inches.

12. The firearm according to claim 9 wherein said one blank cartridge is a 0.45 ACP blank cartridge, said modified cartridge headspacing distance being less than about 0.889 inches.

13. The firearm according to claim 9 wherein said one blank cartridge is a 40 S&W blank cartridge, said modified cartridge headspacing distance being less than about 0.840 inches.

14. The firearm according to claim 5 wherein said barrel has a retaining surface associated therewith, said retaining surface in contacting engagement with said recoil spring mechanism.

15. A firearm adapted to fire blank ammunition which comprises:

a frame;

a slide adapted for reciprocal longitudinal movement relative to said frame between a forward battery position and a rearward position, said slide defining a breech face;

a barrel including a barrel chamber and a barrel element extending from said barrel chamber, said barrel chamber defining a rearwardly displaced headspacing surface, said headspacing surface and said breech face of said slide defining a chamber headspacing distance when said slide is in said forward battery position; and at least one blank cartridge to be positioned within said barrel chamber, said one blank cartridge including a cartridge case and a projectile-shaped member extending from said cartridge case, said cartridge case defining a cartridge headspacing distance approximating said chamber headspacing distance, said cartridge headspacing distance being less than a cartridge headspacing distance of a cartridge case of a live cartridge of corresponding caliber.

16. The firearm according to claim 15 wherein said cartridge headspacing distance of said one blank cartridge is at least about 10% less than the cartridge headspacing distance of the live cartridge of the corresponding caliber.

17. The firearm according to claim 16 wherein said one blank cartridge is selected from the group consisting of a 9 mm caliber cartridge, a 10 mm caliber cartridge, a 0.45 ACP caliber cartridge and a 40 S&W caliber cartridge.

18. The firearm according to claim 16 wherein the overall length of said one blank cartridge defined between an extreme forward end of said projectile-shaped member and a rear end surface of said cartridge case is substantially equal to the overall length of the live cartridge of corresponding caliber.

19. The firearm according to claim 9 wherein said modified cartridge headspacing distance is less than that of a cartridge case of a cartridge headspacing distance of a live cartridge of corresponding caliber.

20. The firearm according to claim 15 including an occlusion member at least partially positioned within a longitudinal bore defined in said barrel element, said occlusion member dimensioned to substantially prevent forward discharge of gases to thereby generate sufficient back pressure in said barrel to move said slide rearwardly to said rearward position thereof.

21. The firearm according to claim 1 wherein said frame, said slide and said barrel are dimensioned, configured and adapted to define and operate as a semi-automatic pistol.

22. The firearm according to claim 5 wherein said barrel is mounted for movement relative to said frame.

23. The firearm according to claim 7 wherein said support member is dimensioned such that movement of said slide to said rearward position causes said recoil spring mechanism to exert a rearward force on said retaining surface to thereby urge said barrel rearwardly to a position where said barrel chamber receives a blank cartridge.

24. The firearm according to claim 14 wherein said recoil spring mechanism is dimensioned to exert a rearward force on said retaining surface thereby to urge said barrel rearwardly to a position where said barrel chamber receives a blank cartridge upon movement of said slide to said rearward position.

25. The firearm according to claim 15 wherein said frame, said slide and said barrel are dimensioned, configured and adapted to define and operate as a semi-automatic pistol.

26. In a firearm adapted to fire blank ammunition, the firearm including a frame, a barrel associated with said frame and having a barrel chamber and a barrel element extending from said barrel chamber, and a breech component, the improvement comprising:

an occlusion member at least partially positioned within a longitudinal bore defined in said barrel element, said occlusion member dimensioned to substantially occlude said longitudinal bore to prevent forward discharge of gases therethrough.

* * * * *